US010925368B2

(12) United States Patent
Parris et al.

(10) Patent No.: US 10,925,368 B2
(45) Date of Patent: Feb. 23, 2021

(54) DEVICE FOR TREATING THE HAIR, COMPRISING A SEAL

(71) Applicant: L'OREAL, Paris (FR)

(72) Inventors: Eric Parris, Sannois (FR); Stefania Nuzzo, Paris (FR); Gabin Vic, Semoy (FR); Frederic Woodland, Gagny (FR); Matteo Maletti, Scandiano (IT)

(73) Assignee: L'OREAL, Paris (FR)

( * ) Notice: Subject to any disclaimer, the term of this patent is extended or adjusted under 35 U.S.C. 154(b) by 743 days.

(21) Appl. No.: 15/105,260

(22) PCT Filed: Dec. 8, 2014

(86) PCT No.: PCT/EP2014/076827
§ 371 (c)(1),
(2) Date: Jun. 16, 2016

(87) PCT Pub. No.: WO2015/091043
PCT Pub. Date: Jun. 25, 2015

(65) Prior Publication Data

US 2016/0309868 A1 Oct. 27, 2016

(30) Foreign Application Priority Data

Dec. 19, 2013 (FR) ..... 1363103

(51) Int. Cl.
*A45D 2/00* (2006.01)
*A45D 1/06* (2006.01)
(Continued)

(52) U.S. Cl.
CPC ..... *A45D 2/001* (2013.01); *A45D 1/04* (2013.01); *A45D 1/06* (2013.01); *A45D 7/02* (2013.01)

(58) Field of Classification Search
CPC . A45D 2/001; A45D 1/04; A45D 1/06; A45D 7/02
See application file for complete search history.

(56) References Cited

U.S. PATENT DOCUMENTS 5,781,691 A * 7/1998 Kwok ..... A45D 1/04 132/228
8,136,819 B2 * 3/2012 Yoshitsune ..... F16J 15/025 277/630
(Continued)

FOREIGN PATENT DOCUMENTS

CN 1826068 A 8/2006
CN 102462123 A 5/2012
(Continued)

OTHER PUBLICATIONS

International Search Report dated Mar. 14, 2016, in PCT/EP2014/076827 filed Dec. 8, 2014.
(Continued)

*Primary Examiner* — Rachel R Steitz
*Assistant Examiner* — Brianne E Kalach
(74) *Attorney, Agent, or Firm* — Oblon, McClelland, Maier & Neustadt, L.L.P.

(57) ABSTRACT

A device for treating hair, including two arms configured to move relative to one another between a moved-together configuration for treating the hair and a spaced-apart configuration for inserting hair to be treated between the arms. At least one of the arms includes a seal.

14 Claims, 3 Drawing Sheets

(51) Int. Cl.
*A45D 1/04* (2006.01)
*A45D 7/02* (2006.01)

(56) References Cited

U.S. PATENT DOCUMENTS

| | | | | |
|---|---|---|---|---|
| 2004/0000319 | A1 | 1/2004 | Carballada et al. | |
| 2005/0224091 | A1* | 10/2005 | Cafaro | A45D 1/04 132/228 |
| 2006/0201924 | A1* | 9/2006 | Hirata | A45D 1/04 219/225 |
| 2010/0089413 | A1 | 4/2010 | Wright et al. | |
| 2012/0111356 | A1* | 5/2012 | Vacheron | A45D 1/04 132/228 |
| 2012/0312319 | A1* | 12/2012 | Uwano | A45D 2/001 132/211 |

FOREIGN PATENT DOCUMENTS

| | | | |
|---|---|---|---|
| EP | 1 661 460 | A1 | 5/2006 |
| JP | 52-147143 | | 12/1977 |
| JP | 55-68310 | | 5/1980 |
| JP | 2003-339422 | | 12/2003 |
| WO | WO 2005/011434 | A1 | 2/2005 |

OTHER PUBLICATIONS

Office Action dated Jun. 26, 2018 in Chinese Application No. 201480069352.0.
Communication pursuant to Rules 161(1) and 162 EPC dated Jun. 24, 2016 in Patent Application No. 14814690.5.
Office Action dated Jul. 16, 2019. In Chinese Patent Application No. 201480069352.0.

* cited by examiner

DEVICE FOR TREATING THE HAIR, COMPRISING A SEAL

The present invention relates to devices for treating the hair, and more particularly, but not exclusively, to those intended for caring for and/or shaping the hair, for example straightening.

The invention relates more particularly to a hairstyling tool which is watertight and in particular resistant when used on hair that is very wet and/or covered in haircare product.

BACKGROUND

Within the scope of a treatment of the hair by a professional or consumer, it is known to use tools to be moved along the length of the hair.

For some uses, the tool can be moved along soaking wet hair or hair that is covered in haircare product. In particular, there exist professional care services during which the stylist applies a product to wet hair and then passes a straightening iron over this hair. During this passage of the straightening iron, the product melts and is carried over the lock by the pressure of the tongs of the iron which wring the hair. This results in significant runs along the straightening iron, and these can cause malfunctions of the iron if the water or haircare product passes into the electrical part of the tool, being able to create short-circuits.

There is thus a need for a device for treating the hair which is liquid-tight so as to make the treatment of hair that is very wet and/or covered in haircare product reliable and risk-free for the person handling the device.

SUMMARY

The invention aims to meet this need and its subject is, according to a first of its aspects, a device for treating the hair, comprising two arms that are able to move relative to one another between a moved-together configuration for treating the hair and a spaced-apart configuration for inserting hair to be treated between said arms. According to the invention, at least one of the arms comprises a seal.

According to one embodiment, the seal is sandwiched between a plate for treating the hair and a counter-form housed in said arm. Alternatively, the seal could be arranged—for example gripped—around the treatment plate. According to one embodiment, the arm may comprise a number of seals arranged among the various components of the arm.

The seal can ensure good water-resistance of the device, in particular by preventing any runoff from passing into the interior of a mobile arm of the device while it is being used.

The term "runoff" should be understood as meaning a discharge of fluid, that is to say a liquid or a foam for example, from the hair, in particular under the effect of a wringing pressure and/or heat produced by the device for treating the hair as it passes over the hair.

The expression "cosmetic composition" should be understood as meaning any cosmetic product intended to treat the hair fibre. This composition may be in the liquid, solid or pasty state before being applied to the hair.

The water resistance provided by the seal makes it possible to prevent any risk of short-circuit in the device, in particular when the electrical and/or electronic elements are housed in one of the arms of the device, for example a heating resistor in the case of a straightening iron.

Advantageously, each arm of the device comprises a seal, in particular when the electrical and/or electronic elements are housed in each of the arms of the device.

The configuration and the sandwiched disposition of the seal, between the plate for treating the hair and the counter-form housed in the arm of the device, makes it possible to obtain a water-resistant device that meets precise standards, such as the standard IPX4 in which the device is subjected to a jet of water and must maintain its proper operating state.

For example, the seal is a silicone elastomer or a rubber polymer, such as PU or the like; it has a thickness of between 1 and 3 mm and a width of between 3 and 10 mm.

According to a particular arrangement, the treatment plate has an outer face designed to come into contact with the hair to be treated and an inner face that has a housing suitable for receiving at least one electrical element—for example a heating element. The seal is then disposed at the perimeter of the housing defined in the inner face of the treatment plate; it thus completely surrounds the electrical element. The seal has a degree of elasticity and follows the outer walls of the housing that receives the electrical element.

According to a particular arrangement, the counter-form encloses with the treatment plate the constituent elements of the arm of the device (electrical and/or electronic elements, insulators, etc.). This counter-form may have a lip that bears against the seal. For example, the lip of the counter-form is adapted to the external perimeter of the walls of the housing of the treatment plate. A seal portion is thus sandwiched between the outer walls of the housing that receives the electrical element and the lip of the counter-form bearing against the seal. Watertightness is thus optimal.

According to one embodiment, the plate for treating the hair and the counter-form are secured together by snap-fastening and/or screw-fastening. The seal is thus sandwiched between the treatment plate and the counter-form by force and is then held mechanically by the means for securing the plate to the counter-form. Advantageously, complementary seals, such as sealing washers disposed around the screws, can be arranged in and on the arm of the device according to the invention.

According to one embodiment, the device according to the invention also comprises a rotary electrical interface for connecting a power supply cable. The rotary electrical interface makes it easier to handle the device while treating the hair. In order to increase the sealing of the device as a whole, a double jacket may be arranged on the electrical interface, with a first end secured to the electrical interface and a second end that defines a through-orifice adapted to the cable. The expression "through-orifice adapted to the cable" should be understood as meaning that the dimensions of the orifice are selected so as to match as far as possible the outer sheath of the power supply cable, thereby limiting the ingress of runoffs into the electrical interface and the risk of short-circuits, while allowing rotation while the device is being handled.

For example, a porous element, such as a felt, may be arranged in the orifice of the double jacket. The porous element thus supplements the sealing of the device at the electrical interface by preventing any penetration of droplets along the sheath of the electric cable into the rotary electrical interface. Alternatively, the orifice in the double jacket may be elastic and thus grip the outer sheath of the power supply cable.

Another subject of the invention is a process for treating the hair with the aid of a device according to the invention, comprising the steps of:

applying water and/or a cosmetic composition to the hair, passing the treatment device over the hair.

Additionally, a heat treatment is advantageously carried out, by bringing the lock of hair into contact with at least one heating element of the device, which will for example make it possible to melt, over the period of contact, a cosmetic product previously applied to the hair. This melting can create a runoff along the device which will not be detrimental and will not risk causing a short-circuit on account of the presence of the sandwiched seal. An example of such a heat treatment is described in FR 2910301 in the name of the Applicant.

DESCRIPTION OF THE FIGURES

The invention may be better understood from reading the following detailed description of non-limiting implementation examples thereof and from examining the appended drawing, in which.

DETAILED DESCRIPTION OF AN EMBODIMENT

Figure 1:
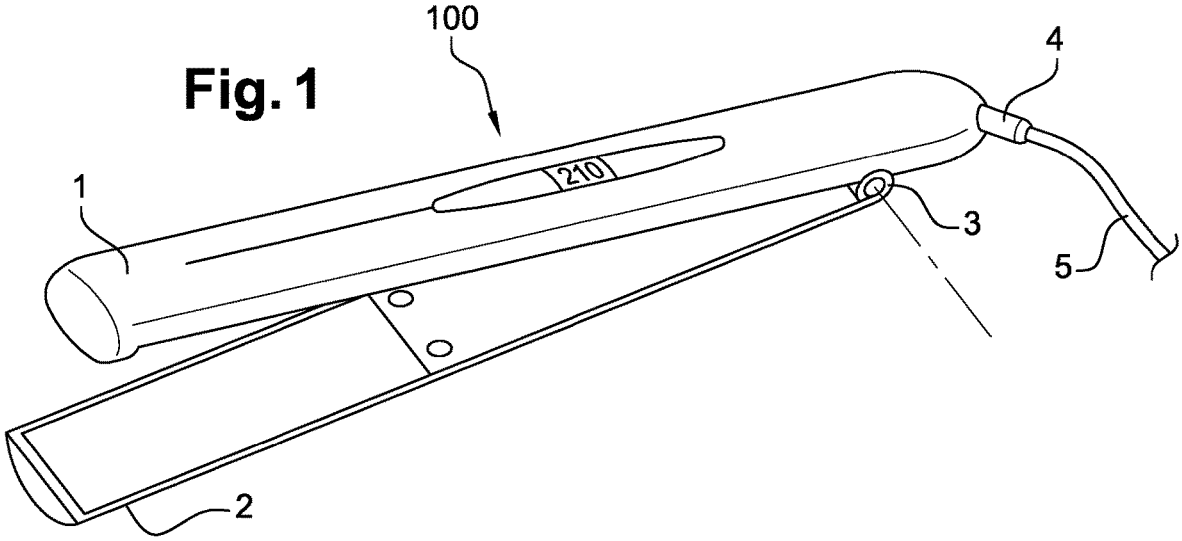
FIG. 1 shows an example of a device for treating the hair according to the invention.

FIG. 1 shows an example of a device for treating the hair according to the invention. Numerous devices of this type, sometimes also known as straightening irons, have already been proposed, for treating a head of hair for the purpose of shaping, with or without prior application of a haircare product to the hair.

In this example, the treatment device is a straightening iron 100 in the form of tongs, comprising two arms 1, 2 that are connected together with the aid of a hinge 3 which makes it possible to open and close said arms, and at least one treatment plate 11 associated with a heating element disposed on at least one of the arms. During operations of styling a lock of hair, said lock is introduced between the two arms 1, 2 in the open position and then the two arms are closed manually over the lock of hair. The lock of hair is then subjected, until the two arms are opened and the lock of hair is removed, to the heat output by the heating element. Such a device 100 is typically supplied with power by an electric cable 5 which can be connected to the device by a rotary electrical interface 4 so as to make it easier to handle the device.

For some styling applications, the hair is wetted and/or impregnated with cosmetic product before the iron is passed through the hair. Runoffs of water and/or of cosmetic haircare product can thus be produced. According to the invention, at least one of the arms 1, 2 comprises a seal sandwiched between the treatment plate 11 and a counter-form housed in said arm.

Figure 2:
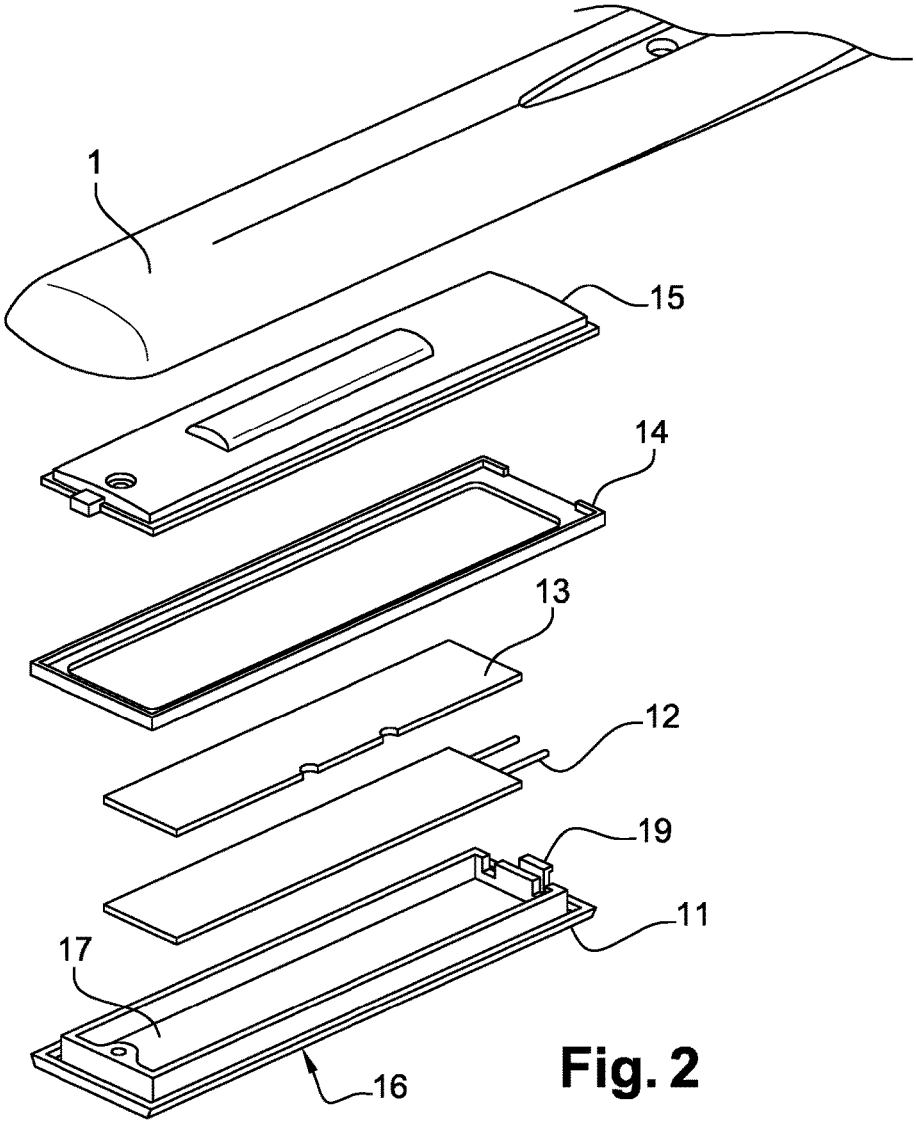
FIG. 2 shows an exploded view of elements arranged in an arm of the device according to the invention.
Figure 3:
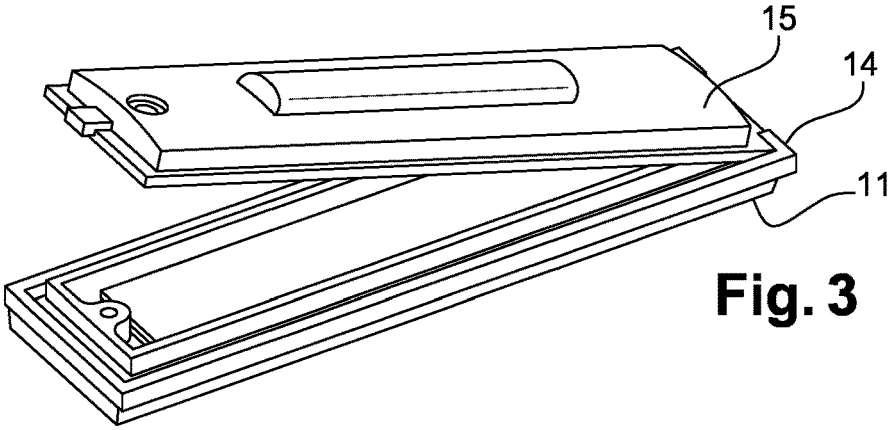
FIGS. 3 and 4 show steps in the fitting of the elements arranged in an arm of the device according to the invention.
Figure 4:
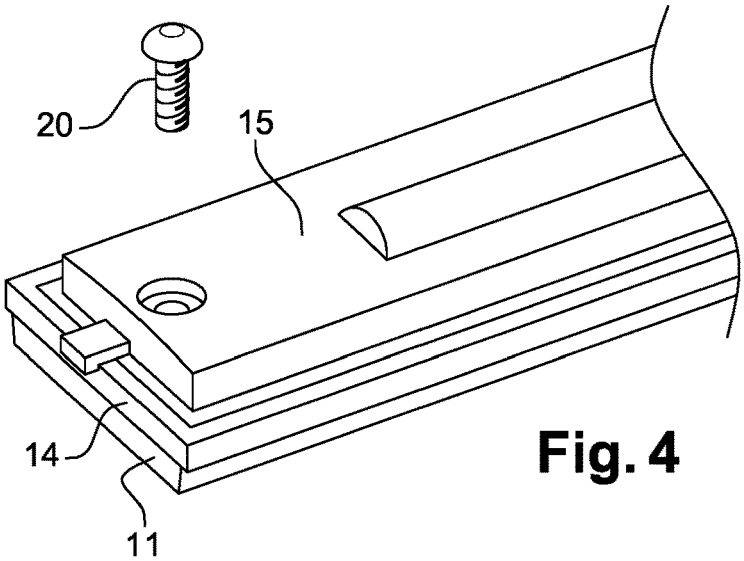

FIG. 2 is an exploded view of elements housed in at least one arm of the device according to the invention. FIG. 2 shows the plate 11 for treating the hair, which may be a metal plate, for example made of aluminium, or a ceramic plate. The treatment plate 11 comprises an outer face 16, which is the one that comes into contact with a lock of hair during the treatment of the hair. The treatment plate 11 comprises an inner face, opposite the outer face 16, which has a housing 17 delimited by side walls that extend substantially perpendicularly to the plane defined by the treatment plate 11 by around 2 to 3 mm. The housing 17 is designed to receive at least one electrical element 12, in particular a resistor for ensuring an increase in temperature of the treatment plate 11. An insulator 13, for example a micanite cardboard, can be placed above the resistor 12 in order to protect the latter. FIG. 2 also shows the seal 14, which has dimensions such that it can be adapted in terms of perimeter to the housing 17 of the treatment plate 11, as illustrated in FIG. 3. FIG. 2 also shows a counter-form 15 which will bear against the seal 14 and close off the housing 17 that receives the electrical element 12, as illustrated in FIGS. 3 and 4.

The seal 14 is then sandwiched between the treatment plate 11 and the counter-form 15. In order to ensure this sandwiching, the treatment plate 11 and the counter-form 15 are secured together, constraining the seal 14. For example, the treatment plate 11 may comprise a tab 19 designed to engage with a groove in the counter-form 15, or vice versa. The treatment plate 11 and the counter-form 15 can thus be secured together, at a first end, by snap-fastening the tab 19 into the groove, as illustrated in FIG. 3, and at the other end by screw-fastening, as illustrated in FIG. 4. Advantageously, a sealing washer can be inserted with the screw 20 in order to improve the sealing of the arm of the device.

Figure 5:
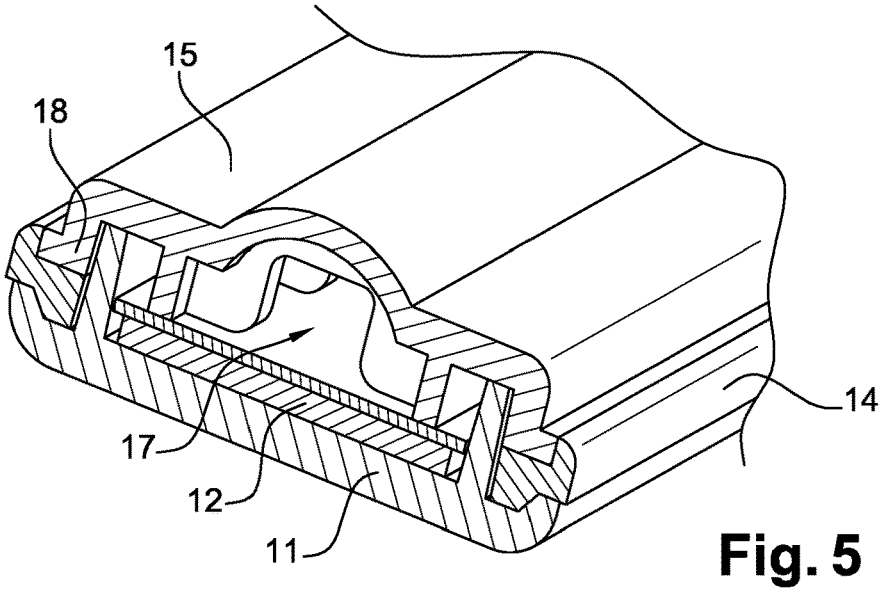
FIG. 5 illustrates a detail of the device according to the invention.

FIG. 5 illustrates the sandwiching of the seal 14 between the treatment plate and the counter-form 15. The seal 14 may be a silicone elastomer; it has the overall shape of a hollow rectangle, with a thickness of between 1 and 3 mm and a width of between 3 and 10 mm. It has a degree of elasticity and its internal dimensions are chosen such that it follows the outer walls of the housing 17 that receives the electrical element 12. The counter-form 15 for its part has a lip 18 that bears against the seal 14. In FIG. 5, the lip 18 of the counter-form 15 is adapted to the external perimeter of the walls of the housing 17 of the treatment plate 11. A seal portion 14 is thus sandwiched between the outer walls of the housing 17 that receives the electrical element 12 and the lip 18 of the counter-form 15 bearing against the seal. However, the width of the seal 14 is sufficient to outwardly overhang the lip 18 of the counter-form 15.

Figure 6:
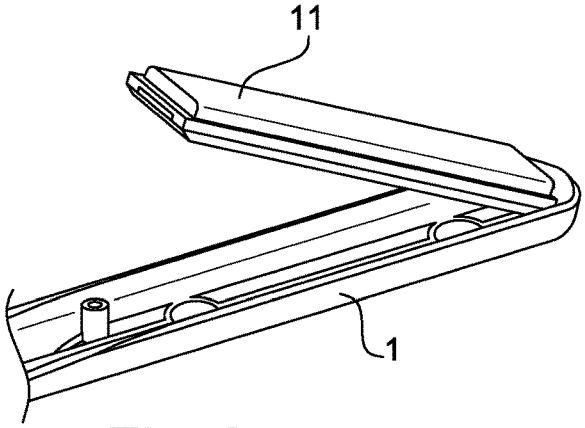
FIGS. 6 to 8 show steps in the fitting of the elements arranged in an arm of the device according to the invention.
Figure 7:
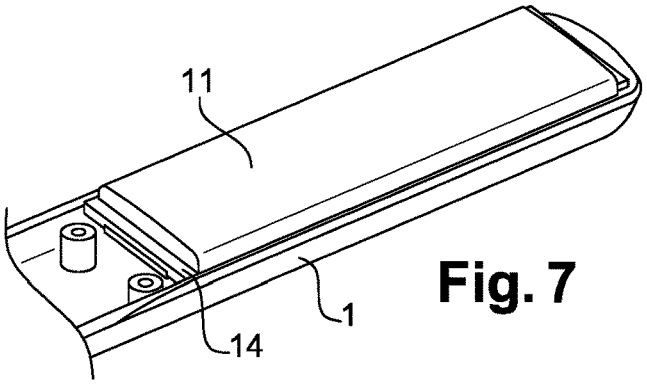
Figure 8:
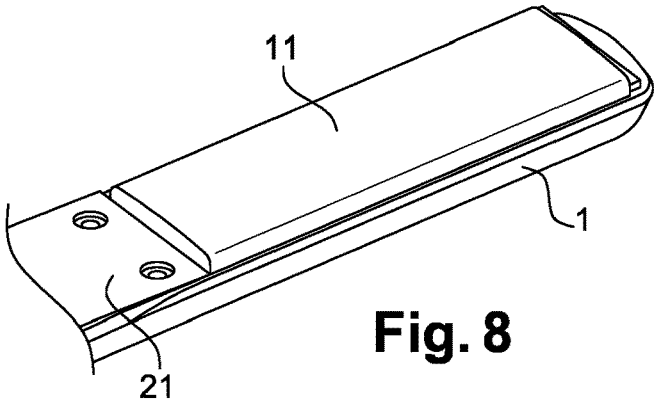

As illustrated in FIG. 6, the assembly formed by the treatment plate 11 and the counter-form 15 sandwiching the seal 14 and enclosing the electrical element 12 is then placed in a recess in the arm 1 of the device, with the treatment plate 11 towards the outside so that it can be in contact with a lock of hair while the device is being used. Once this assembly has been arranged in the arm 1, a cover 21 closes off the rest of the arm 1, as illustrated in FIG. 8. In FIG. 7, it can be seen that the seal 14 overhangs the assembly of the secured-together treatment plate 11 and counter-form 15. The cover 21 thus bears against an overhanging portion of the seal 14, thereby improving the sealing of the assembly. The cover 21 can be screw-fastened, and sealing washers can be inserted with the screws, or the cover 21 can be fastened by any other means, such as snap-fastening, sliding, adhesive bonding or the like.

Figure 9:
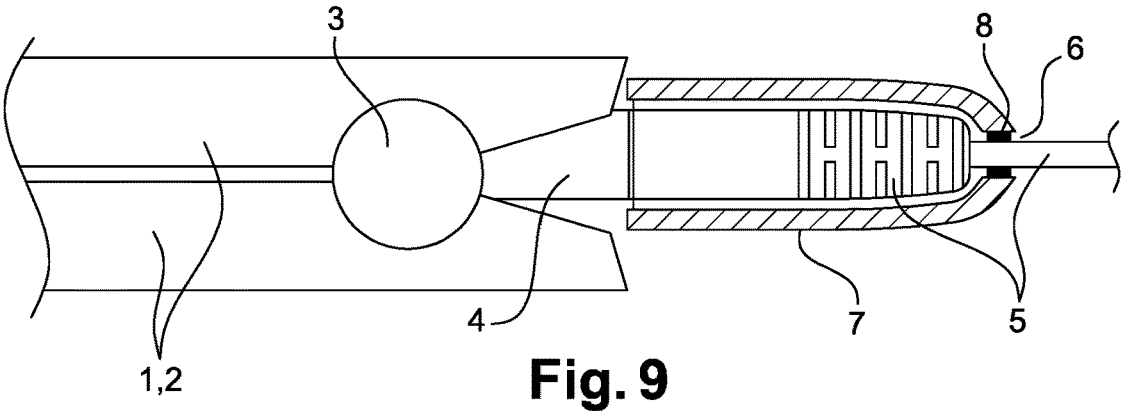
FIG. 9 shows an embodiment of the device according to the invention.

FIG. 9 illustrates an embodiment in which the overall sealing of the device for treating the hair is supplemented by a double jacket 7 positioned on the electrical interface 4. The double jacket 7 has a first end secured to the electrical interface 4, for example adhesively bonded thereto, and a second end which defines a through-orifice 6 adapted to the cable 5, that is to say an orifice 6 which has dimensions that are just enough for the cable to pass through it, but without a significant gap. For example, the orifice 6 may be elastic and grip the cable. FIG. 9 illustrates a porous element 8 arranged in the orifice 6 so as to prevent any penetration of water therethrough.

The device 100 as a whole is thus watertight, and can in particular meet the requirements of standards IPX4 or above. Such a device can be used quite safely on hair that is very wet or covered with products, without runoffs caused by the treatment hampering proper operation of the device.

The invention is not limited to a straightening iron as the device for treating the hair. The device may be any appliance for caring for, shaping (straightening, curling or crimping hair), dyeing or bleaching hair and/or any electrical tool that brings about a runoff during its movement and requires sealed protection with respect to this runoff.

The expression "comprising a" is synonymous with "comprising at least one".

The invention claimed is:

1. A device for treating hair, comprising:

two arms configured to move relative to one another between a moved-together configuration for treating the hair and a spaced-apart configuration for inserting hair to be treated between the two arms, at least one arm of the two arms including a seal sandwiched between a treatment plate for treating the hair and a counter-form housed in the at least one arm of the two arms, the seal having a continuous hollow shape and lining a perimeter of the treatment plate and the counter form, the seal configured to provide a watertight seal, a cover formed separate from the counter-form and the at least one arm of the two arms, disposed adjacent to and abutting the treatment plate, and configured to close off a portion of the at least one arm of the two arms on a side of the treatment plate that is separate from the treatment plate, and an insulator plate disposed between the treatment plate and the counter-form, the insulator plate being substantially planar in shape and parallel to the treatment plate, wherein the seal overhangs both the treatment plate and the counter-form such that the seal terminates at a point wider than the treatment plate and the counter-form along a plane of the treatment plate, and the cover bears against the over-hanging portion of the seal.

2. A device for treating hair according to claim 1, wherein each arm has a seal.

3. A device for treating the hair according to claim 1, wherein the seal is a silicone elastomer or a rubber polymer.

4. A device for treating the hair according to claim 1, wherein the seal has a thickness of between 1 and 3 mm.

5. A device for treating the hair according to claim 1, wherein the seal has a width of between 3 and 10 mm.

6. A device for treating the hair according to claim 1, wherein the at least one arm of the two arms further includes a heating plate, and the treatment plate includes an outer face configured to come into contact with the hair to be treated and an inner face including a housing configured to receive the insulator plate and the heating plate, the heating plate being disposed adjacent to the treatment plate on a first side of the heating plate, the insulator plate being disposed adjacent to the heating plate on a second side of the heating plate.

7. A device for treating the hair according to claim 6, the counter-form including a lip that bears against the seal.

8. A device for treating the hair according to claim 7, wherein the treatment plate and the counter-form are secured together by snap-fastening and/or screw-fastening.

9. A device for treating the hair according to claim 1, further comprising a rotary electrical interface for connecting a power supply cable, a double jacket arranged on the electrical interface and including a first end secured to the electrical interface and a second end that defines a through-orifice adapted to the cable.

10. A device for treating the hair according to claim 9, further comprising a porous element arranged in the orifice in the double jacket.

11. A cosmetic process for treating hair with aid of a device according to claim 1, comprising:

applying water and/or a cosmetic composition to the hair, and passing the treatment device over the hair.

12. A process for treating hair according to claim 11, wherein the device is a straightening iron comprising at least one heating plate, passage of which along the hair brings about a runoff resulting from melting of at least one compound of a cosmetic composition previously applied to the hair.

13. A device for treating hair, comprising:

a rotary electrical interface for connecting a power supply cable; and two arms configured to move relative to one another between a moved-together configuration for treating the hair and a spaced-apart configuration for inserting hair to be treated between the two arms, at least one arm of the two arms including a double jacket arranged on the rotary electrical interface, a seal sandwiched between a treatment plate for treating the hair and a counter-form housed in the at least one arm of the two arms, the seal having a continuous hollow shape and lining a perimeter of the treatment plate and the counter form, the seal configured to provide a watertight seal, a cover formed separate from the counter-form and the at least one arm of the two arms, disposed adjacent to and abutting the treatment plate, and configured to close off a portion of the at least one arm of the two arms on a side of the treatment plate that is separate from the treatment plate, and an insulator plate disposed between the treatment plate and the counter-form, the insulator plate being substantially planar in shape and parallel to the treatment plate, wherein the seal overhangs both the treatment plate and the counter-form such that the seal terminates at a point wider than the treatment plate and the counter-form along a plane of the treatment plate, and the cover bears against the over-hanging portion of the seal.

14. A device for treating hair according to claim 13, wherein the at least one arm of the two arms further includes a heating plate, and the treatment plate includes an outer face configured to come into contact with the hair to be treated and an inner face including a housing configured to receive the insulator plate and the heating plate, the heating plate being disposed adjacent to the treatment plate on a first side of the heating plate, the insulator plate being disposed adjacent to the heating plate on a second side of the heating plate.

* * * * *